United States Patent [19]

Goupil

[11] Patent Number: 5,003,790

[45] Date of Patent: Apr. 2, 1991

[54] ADAPTOR TO CONVERT A BOTTLE FED WATER COOLER INTO A DEVICE SUPPLIED WITH PRESSURIZED WATER FROM THE LOCAL PIPING SYSTEM

[76] Inventor: Robert Goupil, 706 Boulevard Pie XII, Ste-Foy, Quebec, G1X 3S2, Canada

[21] Appl. No.: 394,485

[22] Filed: Aug. 16, 1989

[51] Int. Cl.[5] ..... B67D 5/62

[52] U.S. Cl. ..... 62/389; 62/397

[58] Field of Search ..... 62/389, 397, 337, 338, 62/339; 222/108, 183

[56] References Cited

U.S. PATENT DOCUMENTS

| | | | |
|---|---|---|---|
| 2,186,900 | 1/1940 | Dick et al. | 62/397 X |
| 2,359,791 | 10/1944 | Ralston | 62/397 X |
| 2,360,491 | 10/1944 | Hait | 62/397 X |
| 3,170,307 | 2/1965 | Best | 62/397 X |

*Primary Examiner*—Lloyd L. King

*Attorney, Agent, or Firm*—Helfgott & Karas

[57] ABSTRACT

An adaptor for converting a domestic bottle fed water cooler into a device supplied from the local piping system. The adaptor comprises a circular body attached to the bottle support ring of the cooling unit and incorporates a float valve to maintain the water level in the cooler constant. The connection between the water supply piping system and the adaptor is made by a conduit incorporating a filtering system.

10 Claims, 3 Drawing Sheets

ADAPTOR TO CONVERT A BOTTLE FED WATER COOLER INTO A DEVICE SUPPLIED WITH PRESSURIZED WATER FROM THE LOCAL PIPING SYSTEM

FIELD OF THE INVENTION

The present invention relates to the general field of water processing and, more particularly, to an adaptor to convert a conventional water cooler supplied from a bottle into a device fed from the water supply piping of the dwelling. Advantageously, the adaptor is provided with a filtration system.

BACKGROUND OF THE INVENTION

In the past recent years, many scientific studies have been published clearly showing that the various chemical products added to the drinking water supply for preventing bacteria growth may have adverse effects on the human body. In addition, certain types of additives such as those containing chlorine give an objectionable taste and color to the water.

These reasons explain the increasing popularity of mineral drinking water as a substitute for tap water. Mineral drinking water is commercially available in disposable containers of various sizes or it may be obtained from a supplier in large 18 liter money-back bottles designed to be used exclusively with domestic water cooling units. Typically, such water cooling devices are in the form of a cabinet with a support fixture for the bottle in an inverted condition supplying water by gravity to an internal reservoir cooled by a suitable refrigeration system. Cool water is distributed from the internal reservoir through a manually operated stop cock.

Although these bottle fed water coolers are convenient, they are expensive to use on a long term basis considering the high costs for the service to refill and deliver on site the water bottles.

OBJECT AND STATEMENT OF THE INVENTION

An object of the present invention is an adaptor to convert a domestic bottle fed water cooler into a device supplied with pressurized water from the local piping system.

Another object of the invention is an adaptor to convert a domestic bottle fed water cooling unit into a device supplied with pressurized water from the local piping system, with filtering capabilities to purify the water.

According to one aspect of the invention, the adaptor comprises a body mounted to the water cooler, provided with a conduit for connection to a pressurized water supply, the conduit leading to the receptacle of the water cooler normally used to receive the neck of the bottle. A control valve is coupled to the conduit for regulating the water flow. The valve is required because with the adaptor the water supply pressure is considerably higher comparatively to the bottle feeding system.

In a preferred embodiment, a simple float valve is used which maintains the water level in the reservoir of the water cooler virtually constant.

Advantageously, a filtering device is mounted between the water source and the adaptor to purify the water supplied to the cooler.

DESCRIPTION OF A PREFERRED EMBODIMENT

Figure 1:
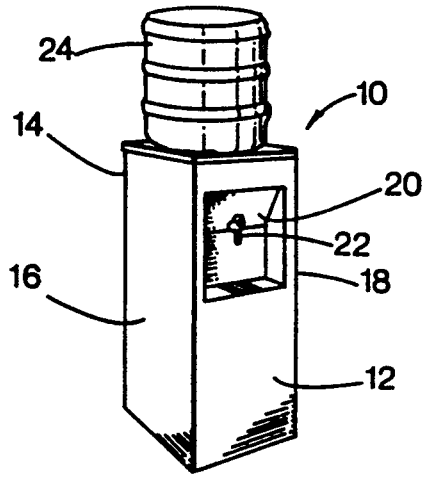
Fig 1 PRIOR ART
FIG. 1 is a perspective view of a conventional bottle fed water cooler.
Figure 4:
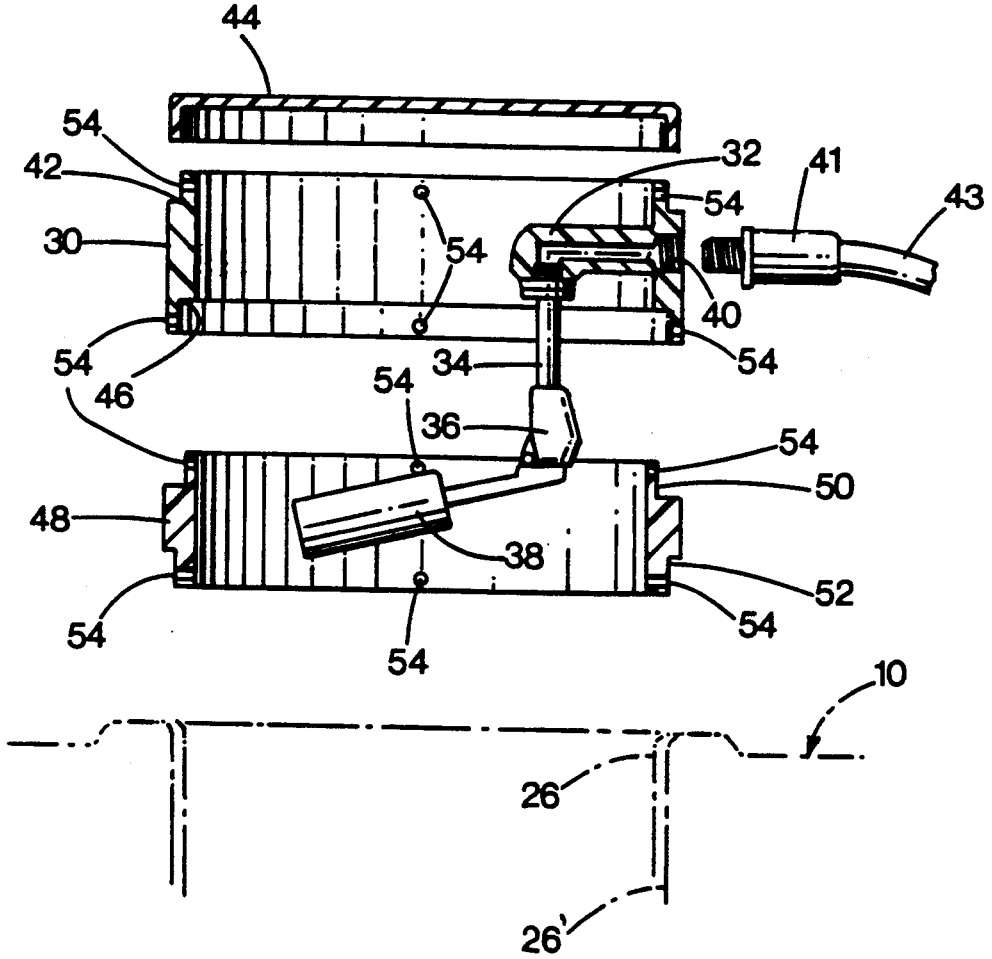
FIG. 4 is a vertical cross-sectional view of the adaptor shown in FIG. 3.
Figure 5:
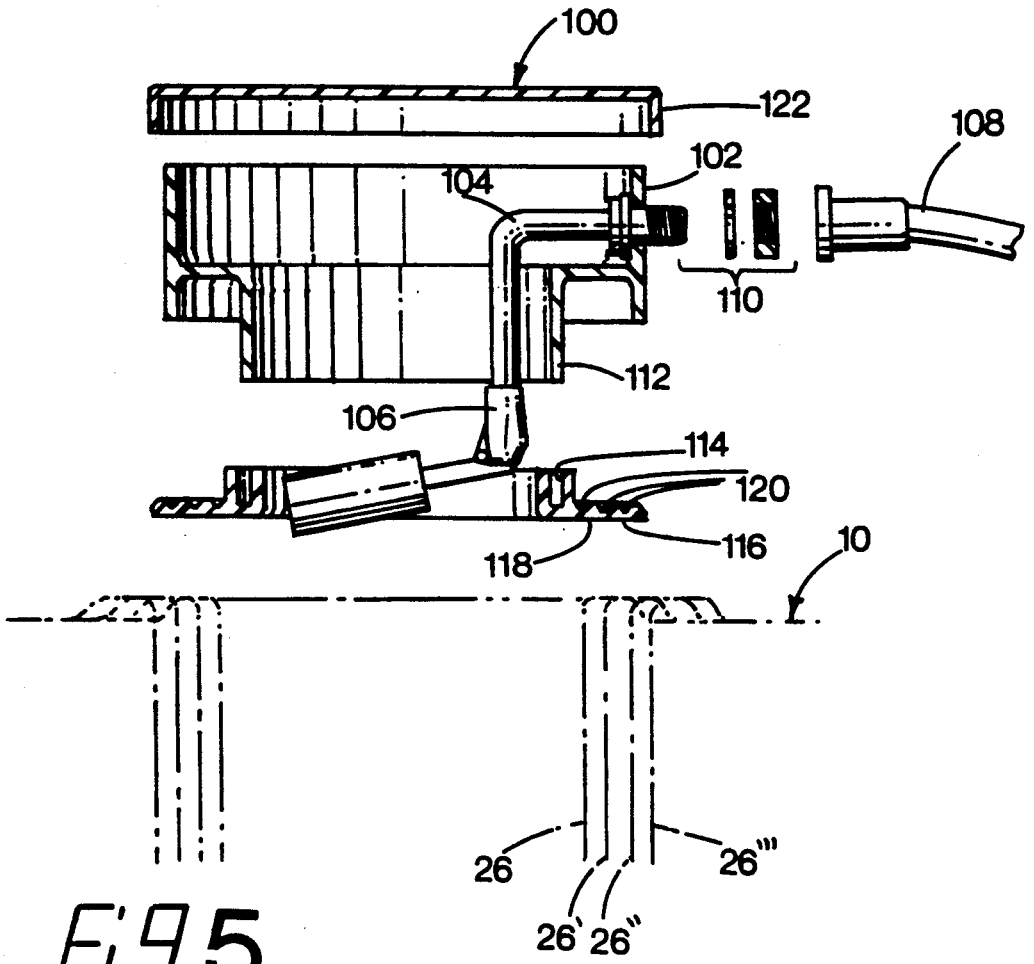
FIG. 5 is a vertical cross-sectional view of a variant of the adaptor.

FIG. 1 of the annexed drawings, illustrates a conventional bottle fed domestic water cooler 10 in the form of a generally rectangular cabinet displaying front and rear vertical walls 12 and 14 and lateral vertical walls 16 and 18. In a recess 20 formed on the front wall 12 is mounted a stop cock 22 to pour water. The stop cock 22 is supplied with water from an 18 liter plastic bottle 24 resting in an inverted position on a specially provided annular seat 26 formed on the top surface of the water cooler 10, receiving the neck of the bottle 24. The seat 26 is best illustrated in FIGS. 4 and 5. The fluid path between the bottle 24 and the stop cock 22 includes a reservoir cooled by a refrigeration system of conventional construction (not shown).

Figure 2:
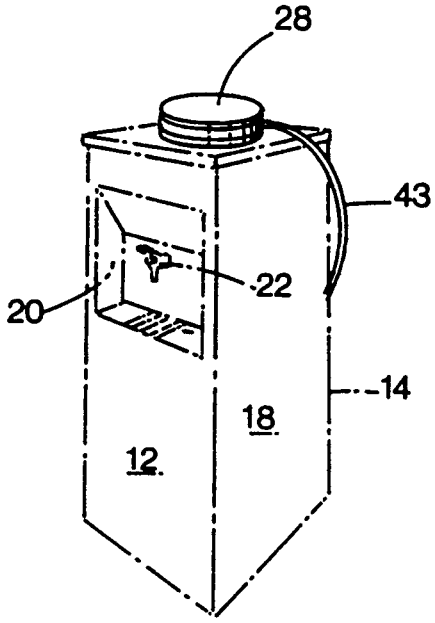
FIG. 2 is a perspective view of the water cooler provided with the adaptor in accordance with the invention.
Figure 3:
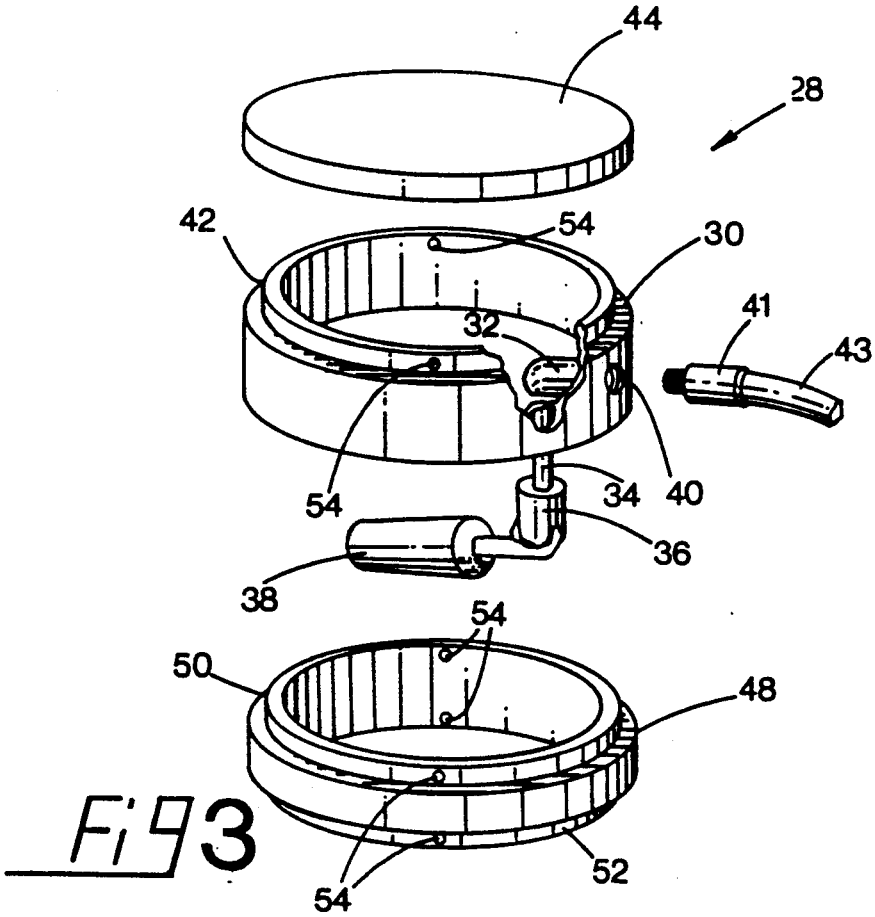
FIG. 3 is an exploded view of the adaptor.

FIGS. 2 and 3 illustrate an adaptor 28 to convert the bottle fed cooling unit 10 into a device supplied with pressurized water from the local piping system, thus eliminating the necessity of constantly refilling the bottle 24 with water. Another advantage of the adaptor is that it continuously supplies the cooling system with water and there is no need to perform a bottle replacing operation as in a conventional unit, which may be dangerous considering the weight of a full bottle.

The adaptor 28 comprises an annular body 30 made of plastic or other type material having the required rigidity and strength characteristics, including a hollow radially extending projection 32. A relatively short conduit 34 coupled to the projection 32 establishes a fluid path between the hollow internal zone of the projection 32 and a float valve 36. The latter is of a conventional construction and comprises a valve seat and a plunger assembly (not shown) mounted at the lower end of the conduit 34, the plunger being operated by a float 38.

Water under pressure is supplied to the hollow internal region of the projection 32 through a tapered inlet port 40 for accepting a fitting 41 of conventional construction at the extremity of the water supply pipe 43.

The upper extremity of the annular body 30 is provided with a circumferentially extending groove 42 to accept a lid 44 which when closed prevents dust or other foreign material to penetrate within the annular body 30.

On the inner face of the annular body 30, at the lower end thereof, is provided a circumferentially extending groove 46 which serves to receive a base ring 48 to adapt the annular member 30 to various sizes of bottle seats 26. The most popular diameters of bottle seats are 6, 6¼, 6½, 6¾ and 7 inches. As the description proceeds, it will become apparent how the adaptor may be modified for installation on bottle supports of different diameters. The base ring 48 is made preferably of the same material used for the construction of the annular member 30 and it comprises circumferentially extending grooves 50 and 52 provided adjacent the top and bottom edges of the base ring respectively, the groove 50 being substantially deeper than the groove 52. The groove 52 is of the same depth as the grooves 42 and 46 on the member 30.

To permit a connection between the member 30 and the base ring 48, radially extending and tapped openings to accept set screws are provided on the members 30 and 48, more particularly at overlapping areas between these components when assembled together. The openings are identified by the reference numeral 54. It should be appreciated that the openings 54 also serve to receive set screws for attaching the adaptor 28 to the bottle seat 26, as it will be described in detail hereinafter.

The operation of the device is as follows. When the adaptor 28 is to be installed on water coolers having a bottle support ring with an internal diameter of 6¾ or 7 inches, the base ring 48 is not required for the installation. The annular body 30 whose diameter is less than 6¾ of an inch is slipped within the bottle support ring until the lower edge penetrates a certain distance therein and four set screws are treaded in the openings 54 and tightened to hold the annular member 30 securely in place. A conduit from the local water supply piping system is connected to the inlet port 40. It will be appreciated that water will flow in the cooler 10 through the fluid path established by the hollow region of the extension 32, the conduit 34 and the float valve 36. As it is well known to those skilled in the art, the latter will maintain a constant water level in the cooler 10.

When the adaptor 28 is to be mounted on a water cooler with a bottle support ring having a diameter of 6 ⅛ inches, illustrated in dashed lines by the numeral 26' in FIG. 4, the annular member 30 must be employed with the base ring 48 in the position shown in FIG. 4. The base ring 48 is slipped within the annular member 30 until the horizontal surface defined by the groove 50 abuts against the horizontal surface of the groove 46. Set screws are engaged in the openings 54 of the annular member 30 to retain both components together. In that position, the assembly is slipped within the bottle support ring 26' and secured by set screws as described earlier.

For a bottle support ring having a diameter of 6 inches or 6¼ shown by the reference numeral 26 in FIG. 4, the base ring 48 must be used into an inverted position of what is shown in FIG. 4, in other words the groove 52 will be on top. The mounting of the system is the same as described earlier.

To purify the water supplied from the local piping system, it is preferred to install upstream of the adaptor 28 a filtering device (not shown). The type of filter used may vary in accordance with the intended application. However, as an example only, water filters commercialized under the trademark NSA have been found satisfactory.

Figure 6:
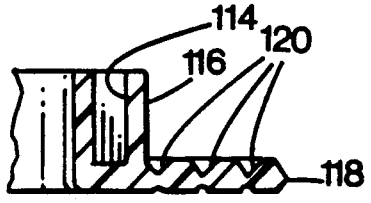
FIG. 6 is an enlarged view in section of a component of the adaptor illustrated in FIG. 5.

Modifications are possible. Referring to FIG. 5, the adaptor 100 comprises a unitary annular member 102 provided with a conduit 104 carrying a float valve 106 at one end, the opposite end thereof passing through the annular member 102 for connection to a water supply pipe 108 by means of conventional fittings 110. The annular member 102 includes a downwardly extending collar 112 slidingly received into a vertically extending circular groove 114 of a base ring 116 that serves to adapt the annular member 102 to various diameters of bottle support rings illustrated in dashed lines by the numerals 26, 26', 26'', 26'''. The base ring 116 includes a radially projecting flange 118 with three circular and concentric score lines 120, best illustrated in FIG. 6.

A removable lid 122 is provided to close the annular member 102.

To install the adaptor 100, the collar 112 of the annular member 102 is inserted in the groove 114 of the base ring 116. If the assembly is to be installed on a bottle support ring 26''', the base ring 116 does not have to be modified. The assembly is inserted in the bottle support ring until the annular member 102 is firmly seated thereon. Finally, the water supply pipe 108 is connected to the conduit 104 and the lid 122 is closed.

When the adaptor 100 is to be mounted on a smaller bottle support ring, the diameter of the base ring 116 is reduced by sectioning the flange 118 at the appropriate score line 120.

It should be understood that the above description of the preferred embodiment of this invention should not be interpreted in any limiting manner since various refinements are possible without departing from the spirit of the invention. The scope of the invention is defined in the annexed claims.

I claim:

1. An adaptor for converting a water cooler supplied with water from a bottle having a neck, into a water cooler supplied with pressurized water from a local piping system, said cooler supplied with water from a bottle being of the commercially available type including an annular seat defining an opening for receiving the neck of the bottle placed in inverted position on said seat, and a cooled reservoir having an upper, open end through which the neck of the bottle extends to supply water into said reservoir, said adaptor comprising:

an annular body;

means for mounting said body on the annular seat of the cooler; and valve means mounted on the annular body and connected to the local piping system for supplying water into the cooled reservoir, said valve means comprising means for controlling a supply of water into and a level of water in said reservoir, whereby sealing of the cooled reservoir for converting the cooler from a bottle supply mode of operation to a piping system supply mode of operation, is unnecessary.

2. An adaptor as defined in claim 1, wherein said controlling means comprises a float valve operated by the level of water in said reservoir.

3. An adaptor as defined in claim 1, wherein said means for mounting said body on the annular seat comprise a base ring having a lower portion contoured to fit onto said annular seat and an upper portion contoured to receive said annular body.

4. An adaptor as defined in claim 3, wherein said lower and upper portions of the base ring are grooved.

5. An adaptor as defined in claim 1, wherein said annular body is formed with a lower portion contoured to fit onto said annular seat, said lower portion constituting said means for mounting said body on the annular seat.

6. An adaptor as defined in claim 1, wherein said reservoir comprises a generally cylindrical inner surface, and wherein said means for mounting said body on the annular seat comprise a flat, generally circular member including a generally circular score line whereby said flat member can be fractured to adapt a diameter thereof to that of the inner surface of the reservoir and to thereby enable insertion of said circular member into said reservoir.

7. An adaptor as defined in claim 6, wherein said flat, generally circular member comprises a plurality of generally circular score lines.

8. An adaptor as defined in claim 1, wherein said means for mounting said annular body on the annular seat comprise a generally circular member mounted on said body and including at least one generally circular score line to fracture said circular member.

9. An adaptor as defined in claim 1, and further comprising a lid for covering said annular body.

10. An adaptor as defined in claim 9, wherein said lid comprises a peripheral flange, and said annular body comprises an upper portion which is grooved to receive said peripheral flange of the lid.

* * * * *